US012005998B2

(12) United States Patent
Warnan et al.

(10) Patent No.: US 12,005,998 B2
(45) Date of Patent: Jun. 11, 2024

(54) FAIRED TOWING CABLE

(71) Applicant: THALES, Courbevoie (FR)

(72) Inventors: François Warnan, Brest (FR); Jean-Philippe Longuet, Brest (FR); Laurent Helias, Brest (FR); Frédéric Gregoire, Brest (FR); Paul Tanniou, Brest (FR)

(73) Assignee: THALES, Courbevoie (FR)

( * ) Notice: Subject to any disclaimer, the term of this patent is extended or adjusted under 35 U.S.C. 154(b) by 384 days.

(21) Appl. No.: 17/311,253

(22) PCT Filed: Dec. 11, 2019

(86) PCT No.: PCT/EP2019/084583
§ 371 (c)(1),
(2) Date: Jun. 4, 2021

(87) PCT Pub. No.: WO2020/120544
PCT Pub. Date: Jun. 18, 2020

(65) Prior Publication Data

US 2022/0024545 A1 Jan. 27, 2022

(30) Foreign Application Priority Data

Dec. 11, 2018 (FR) ..... 1872638

(51) Int. Cl.
*B63B 21/66* (2006.01)

(52) U.S. Cl.
CPC ..... *B63B 21/663* (2013.01)

(58) Field of Classification Search
CPC ... B63B 21/56; B63B 2021/566; B63B 21/66; B63B 21/663
USPC ..... 114/242, 243, 253
See application file for complete search history.

(56) References Cited

U.S. PATENT DOCUMENTS 3,343,516 A * 9/1967 Nichols ..... B63B 21/663 114/243
3,379,161 A 4/1968 Nichols et al.
5,050,445 A * 9/1991 Duffy ..... F16C 1/26 74/502.5
6,189,475 B1 * 2/2001 Coakley ..... B63B 21/663 367/20
6,416,369 B1 * 7/2002 Coakley ..... B63B 21/56 114/242

FOREIGN PATENT DOCUMENTS

GB 2 192 015 A 12/1987
WO 84/02890 A1 8/1984

* cited by examiner

*Primary Examiner* — Daniel V Venne
(74) *Attorney, Agent, or Firm* — BakerHostetler

(57) ABSTRACT

A faired towing cable employed on a ship for towing a submersible body launched at sea is provided. The cable comprises a core and a fairing joined to the core. The fairing is profiled so as to reduce the hydrodynamic drag of the cable. The fairing comprises several leading edges and several trailing edges joined to the leading edges. One trailing edge is held directly on two adjacent leading edges.

12 Claims, 5 Drawing Sheets

FAIRED TOWING CABLE

CROSS-REFERENCE TO RELATED APPLICATIONS

This application is a National Stage of International patent application PCT/EP2019/084583, filed on Dec. 11, 2019, which claims priority to foreign French patent application No. FR 1872638, filed on Dec. 11, 2018, the disclosures of which are incorporated by reference in their entirety.

FIELD OF THE INVENTION

The present invention relates to faired towing cables employed on a ship for towing a submersible body launched at sea. It relates more particularly to towing cables which are faired by means of scales or portions articulated to one another. The invention may be implemented for any type of faired elongate element intended to be at least partially submerged.

BACKGROUND

The context of the invention is that of a ship intended to tow a submersible object such as a variable-depth sonar antenna incorporated into a towed body. In such a context, in a non-operational phase, the submersible body is stored on board the ship and the cable is wound around the drum of a winch used for winding in and paying out the cable, in order to put the submersible object into and recover it from the sea. In an operational phase, the submersible body is submerged behind the ship and towed by the latter by means of the cable, the end of which that is connected to the submersible body is submerged. The cable is wound in/paid out by the winch by way of a cable guiding device that allows the cable to be guided.

In order to achieve a high degree of submersion at high towing speeds, the towing cable is faired so as to reduce its hydrodynamic drag and the vibrations caused by the hydrodynamic flow around the cable. The cable is covered with a segmented fairing made up of fairing elements having shapes intended to reduce the hydrodynamic drag of the cable. The role of the fairing elements is to reduce the wake turbulence produced by the movement of the cable through the water, when this cable is immersed in the water and towed by the ship. The fairing elements need to be rigid for great submersion depths that go hand-in-hand with high towing speeds that may exceed 20 knots. It will be recalled that the knot is a unit of speed commonly used in the maritime and aeronautical fields. A knot is equal to 1.852 km/h. Flexible fairings are of benefit only for economically profiling chains or cables for buoys subjected to marine currents or towed at low speeds, typically less than 6 to 8 knots. In the case of the use of rigid fairing components, segmenting the fairing into fairing elements is necessary so that the cable can be wound onto the drum of a winch and pass through guide elements of the pulley type, and so that lateral cable deflection can be tolerated in case the ship changes heading.

In a normal operating state, the fairing elements are able to rotate about the longitudinal axis of the cable. This is because it is necessary for the fairing elements to be able to rotate freely about the cable so as to be correctly oriented with respect to the stream of the water. Apart from the end fairing element, each fairing element is linked to its two neighbors axially and in rotation about the cable, however. The link is ensured by intermediate mechanical parts known as splice plates fitted between each of the fairing elements. The assembly of the fairing elements and splice plates is known as a string of fairing.

A functional clearance is present between each splice plate and the associated fairing elements in particular to allow the faired cable to pass smoothly through all the guide elements, such as pulleys or fairleads and to be wound around a drum for stowing the cable on the deck of the ship. The rotation of one fairing element causes its neighbors to rotate and so on and so forth through the entire set of fairing elements. Thus, both when the cable is deployed in the water and when it is wound around the drum, any change in orientation of one of the fairing elements has a knock-on effect on all of the fairing elements of the cable. Thus, when the cable is deployed at sea, the fairing elements naturally orient themselves in the direction of the current generated by the movement of the vessel. In the same way, the guide device is conventionally configured to orient and guide the fairing elements that pass through it so that they have a predefined orientation with respect to the drum of the winch. As the cable is raised, all the fairing elements adopt one and the same orientation relative to the drum, this orientation allowing the cable to be wound in with the fairing elements being kept parallel to one another.

The applicant has become aware of a number of difficulties in the use of faired cables.

Faired towing cables are subject to a random twisting phenomenon in their airborne part, that is to say between the surface of the water and the towing device disposed on the deck of the ship. This twisting is not immediately dangerous, but can easily become so if it is not detected in time and reabsorbed. The minimum damage that can result therefrom is the crushing of a part of the string of fairing. This crushing can have limited consequences but it can also degenerate, tear the sheath of the cable, jam the winch or damage it and thus make the entire submerged system unavailable.

The twisting phenomenon can also arise in the submerged part of the cable. This phenomenon coupled with the speed of the cable in the water cause very powerful torsional moments on the fairing elements and on the links thereof.

Since the fairing elements are often made on the basis of plastics materials and the stresses applied by the stream of water are very high, a twist may cause permanent deformations of the fairing elements that are related to creep. Gradually, the twist tightens, thereby increasing the mechanical stresses between the fairing elements all the more. Over time, this inevitably leads to the breakage of fairing elements or of links between fairing elements. Once this breakage has arisen, any discontinuity in the string of fairing can cause the cable to jam as it passes over a pulley and when it is wound on its drum.

Other deformations related to creep can also arise when the faired cable is wound on its drum. More specifically, the links, the means of fastening them to the fairing elements or the fairing elements themselves can stretch on account of the radius of curvature to which the cable is subjected. This permanent elongation impedes the free movement of the entire string of fairing as the cable is paid out.

Still during the winding in of the cable, onto the drum or on passing through a pulley, the parts forming the leading edges of the fairing elements move toward one another and are likely to touch each other and even exert forces on one another, these forces being able to cause deformations or breakages.

The cable may be equipped with crimped rings for longitudinally blocking the fairing elements along the cable. The rings absorb the forces to which the fairing elements are subjected along the axis of the cable. These rings are distributed regularly along the cable with a spacing for example of several tens of fairing elements. During the longitudinal flexing of the cable, which passes over a pulley, the string of fairing that forms and a sheath not linked to the cable naturally adopt a running speed that is necessarily lower than that of the cable. The string of fairing is then gradually pushed against the rings crimped onto the cable. This pressure caused by the passage over the pulley can result in very high pressures and damage the faces of the fairing elements in contact with the rings.

The applicant has also observed damage to the fairing elements at their trailing edge that forms the thinnest part of the fairing element and thus the most fragile part. In spite of all the precautions taken in the guiding surfaces of the pulleys and of the winch, the trailing edges are often damaged as a result of instances of violent contact or even instances of sticking in slots or gaps.

SUMMARY OF THE INVENTION

The invention aims to remedy all or some of the problems set out above by proposing a faired towing cable intended to tow a submersible cable, the cable comprising a core and a fairing joined to the core, the fairing being profiled so as to reduce the hydrodynamic drag of the cable, the fairing comprising several leading edges and several trailing edges joined to the leading edges. One trailing edge is held directly on two adjacent leading edges.

Advantageously, the core extends mainly along an axis, and the trailing edges are disposed in a staggered manner with respect to the leading edges along the axis.

Advantageously, the core extends mainly along an axis. The leading edges form a shell folded around the core. The trailing edges are formed of a profile that ensures the hydrodynamic function of the trailing edge and of two arms that are each disposed inside one of the two adjacent leading edges. Each arm extends at least in a direction perpendicular to the axis. Each arm is held on the corresponding leading edge.

Advantageously, each arm comprises two ends, a first of which is secured to the profile and a second of which is free. Each arm is held on the corresponding leading edge at its second end.

Advantageously, each arm is held on the leading edge by a pivot connection.

Advantageously, the pivot connection is disposed at the second, free end of the corresponding arm, and each leading edge comprises two stops that can each come into contact with a corresponding one of the arms so as to limit the relative movement of the trailing edge and of the leading edge connected by the pivot connection.

Advantageously, the trailing edge comprises an intermediate arm connecting the two arms.

Advantageously, the core extends mainly along an axis, and, for the different leading edges and trailing edges, perpendicularly to the axis of the core, the fairing is located at a distance D with respect to the axis, and a distance d at which the leading edges are located is at least equal to half the distance D.

Advantageously, in a plane containing the axis, a projection of the leading edge is substantially rectangular, with one side being limited by the distance d. The trailing edge comprises a profile that ensures the hydrodynamic function of the trailing edge. A projection of the profile is substantially rectangular, with one of the sides being limited by the distance d and another of the sides being limited by the distance D.

Advantageously, ends of the side of the leading edge have rounded corners, and the profile is configured to follow the rounded corners.

Advantageously, the leading edges and the trailing edges are in one piece and made of homogeneous materials, and a Young's modulus of the material forming the leading edges is greater than a Young's modulus of the material forming the trailing edges.

Advantageously, rings fastened to the core are distributed regularly along the core, the leading edges being able to bear on the rings. The rings are disposed between two adjacent leading edges.

Advantageously, the core extends mainly along an axis. Each leading edge comprises a channel which extends substantially along an axis and in which the core is disposed. The channel widens on either side of a median section of the leading edge, the median section being perpendicular to the axis of the channel.

BRIEF DESCRIPTION OF THE DRAWINGS

The invention will be understood better and further advantages will become apparent from reading the detailed description of an embodiment given by way of example, this description being illustrated by the appended drawing, in which.

For the sake of clarity, the same elements will bear the same references in the various figures.

DETAILED DESCRIPTION

Figure 1:
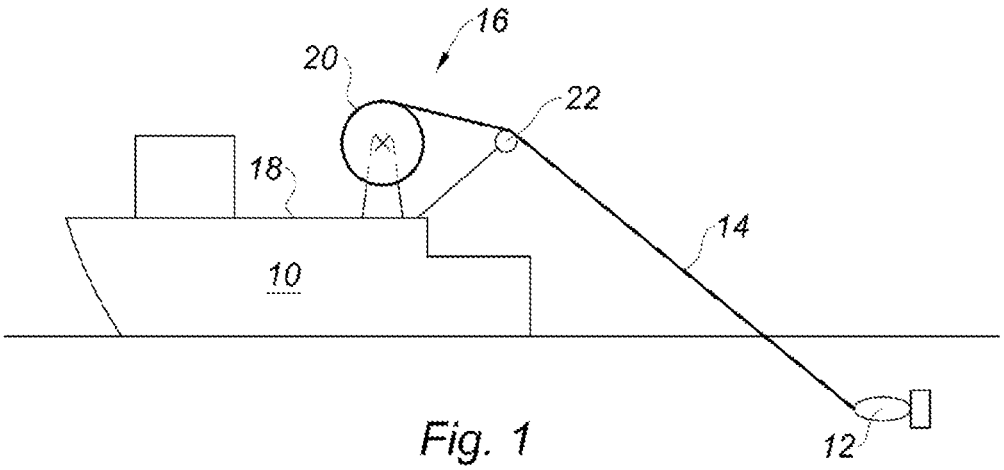
FIG. 1 shows a ship towing a towed object by means of a faired towing cable according to the invention.

FIG. 1 shows a ship 10 towing a submersible object 12 by means of a towing cable 14. The submersible object 12 is for example a sonar antenna, often called a towfish, the depth of which may be variable. The invention is not limited to a sonar antenna. It can be implemented for any type of submersible object, such as seismic detectors or fishing gear.

The submersible object 12 is tethered to the cable 14. The submersible object 12 is put into and removed from the water by means of a winch 16 disposed on a deck 18 of the ship 10. The winch 16 comprises a drum 20 dimensioned to allow the cable 14 to be wound. The cable 14 may be wound onto the drum 20 by passing via a guide device 22, for example a pulley or a fairlead. The drum 20 and the guide device 22 are dimensioned so as to limit the bending of the cable 14. The guide device 22 also makes it possible to limit the lateral deflection of the cable 14 downstream, that is to say on the seaward side, in order to allow the submersible object 12 to be used under heavy sea conditions. The guide device may also be equipped with a reeling device upstream, that is to say on the drum side 20, for stowing the cable 14 on the drum 20.

The cable 14 may be just a mechanical link between the ship 10 and the submersible object 12. Alternatively, the cable 14 may transmit power and signals between the ship 10 and the submersible object 12. The cable may comprise a sheath formed of a strand of metal threads ensuring a degree of flexibility in particular to allow the cable 14 to bend. Inside the sheath, conductors may ensure the transmission of the signals and power. These conductors may be of any kind: electrical, optical, fluidic, etc. The sheath provides the mechanical protection for the internal conductors.

The exterior sheath of the cable generally has a circular cross section. The sheath and any internal conductors will be referred to as core 24 in the following text. As specified in the introduction, the core 24 is advantageously faired, in particular in order to limit its hydrodynamic drag. In order to achieve high towing speeds, the fairing is at least partially rigid. To allow the cable to bend, the fairing is segmented.

Figure 2:
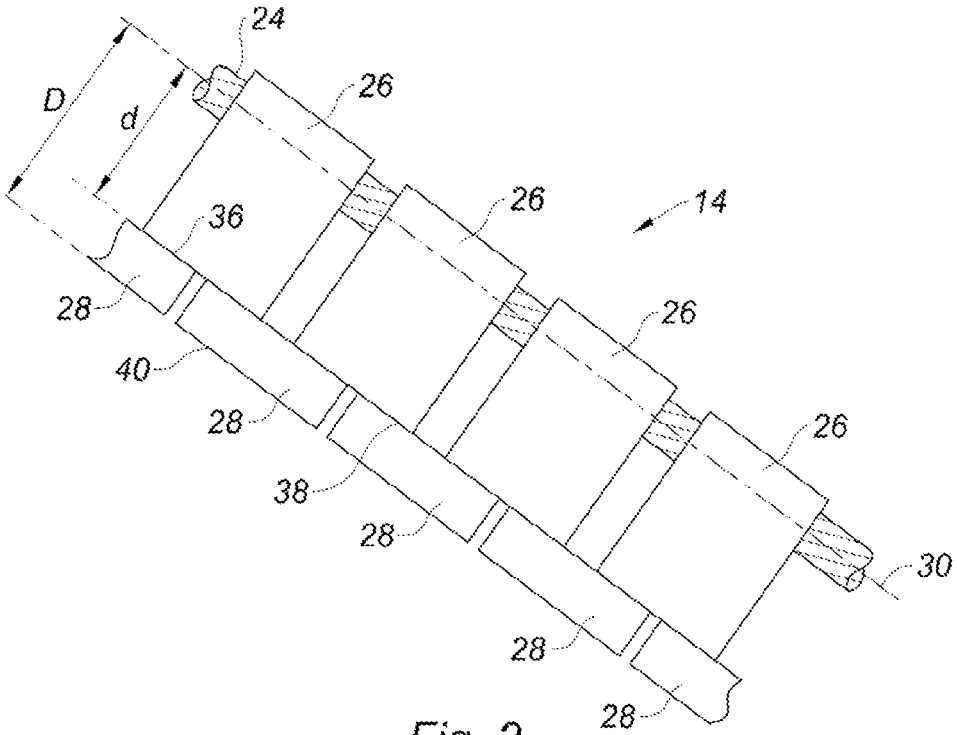
FIG. 2 shows a portion of the faired cable.

FIG. 2 shows a part of the cable 14. The core 24 and its fairing can be distinguished therein. According to the invention, the fairing comprises several leading edges 26 and several trailing edges 28 joined to the leading edges 26.

A leading edge 26 is understood to be a mechanical part that surrounds the core 24 and is intended to be oriented toward the current prevailing in the water when the cable 14 is submerged. Similarly, the trailing edge is a mechanical part situated downstream of the leading edge with respect to the current. The leading edges 26 and the trailing edges 28 comprise external surfaces for reducing the drag of the cable 14 when the latter is subjected to the current.

The various leading edges 26 and trailing edges 28 are advantageously identical to make it easier to produce them. The leading edges 26 may slide along the core 24 and, as mentioned above, the core 24 may be equipped with crimped rings (not shown in FIG. 2) for longitudinally blocking the leading edges 26 along the core 24. The rings absorb the forces to which the leading edges 26 are subjected along the longitudinal axis 30 of the core 24. The leading edges 26 intended to come into contact with the rings may be configured differently than the other leading edges. In the configuration shown in FIG. 2, one trailing edge 28 is held directly on two adjacent leading edges 26 without any intermediate mechanical part.

The holding together of the leading edges 26 and trailing edges 28 makes it possible to ensure continuity of the hydrodynamic profile of the fairing parallel to the axis 30, making it possible to limit the effects of twisting of the cable about the axis 30. The direct holding of one trailing edge 28 on two adjacent leading edges 26 avoids the fitting of intermediate joining parts, often known as splice plates.

Figure 3A:
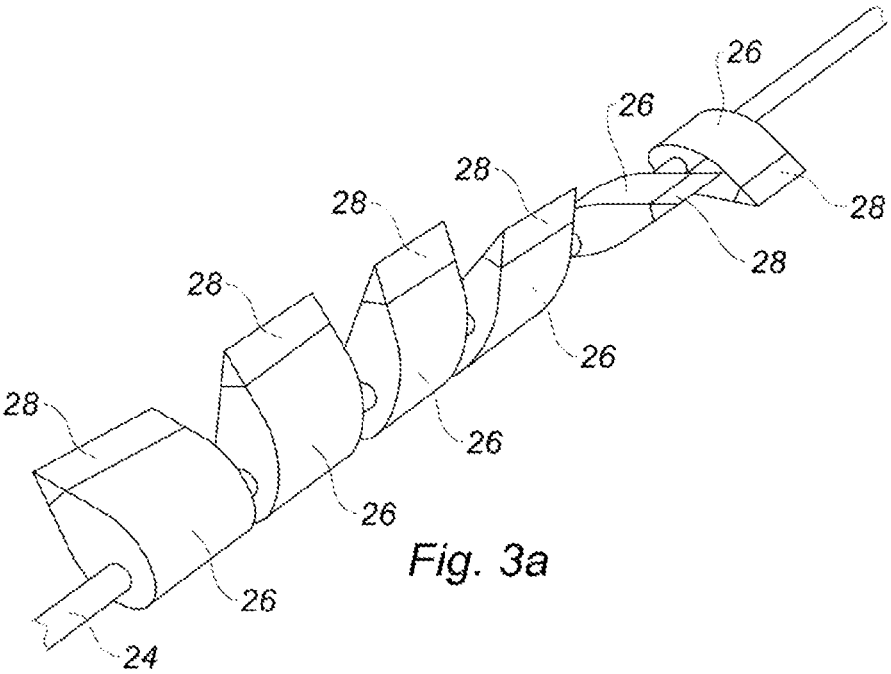
FIGS. 3*a* and 3*b* show perspective views of two faired cable variants subjected to torsion.

In the segmentation of the fairing, it is possible to dispose a trailing edge 28 facing each leading edge 26. More specifically, along the axis 30, the exterior surfaces of a leading edge 26 and of a trailing edge 28, which ensure their hydrodynamic function, occupy one and the same portion along the axis 30. The holding of one trailing edge 28 on two adjacent leading edges 26 is thus ensured by protuberances of the trailing edge that are linked to two adjacent leading edges on the inside thereof. However, this facing disposition of the leading edges 26 and trailing edges 28 causes, in the event of twisting of the cable 24, the different trailing edges to be disposed in a "stepped" manner. More specifically, the downstream end of the trailing edges 28 forms a discontinuous line, this having a detrimental effect on the hydrodynamics of the cable. This stepped disposition is shown in FIG. 3*a*.

Figure 3B:
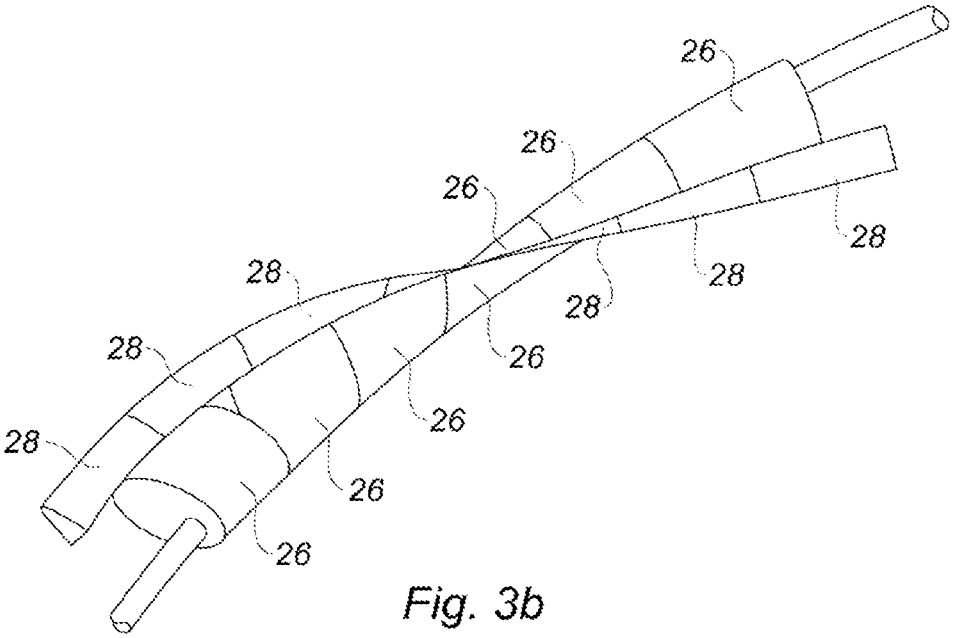

Preferably, as shown in FIG. 2 and in FIG. 3*b*, the trailing edges 28 are disposed in a staggered manner with respect to the leading edges 26 along the axis 30. Thus, when the cable 14 twists, the downstream end of the trailing edges 28 forms a substantially continuous line, as shown in FIG. 3*b*. During twisting, the downstream end of the trailing edges 28 takes on a continuous helical form. The continuous line is advantageous during the passage of the cable through the guide device 22. Specifically, in the case of significant twisting of the cable 14, the discontinuities that are apparent in FIG. 3*a* entail the risk of escaping from the guide device 22 or of striking and catching on any imperfections when the winch 16 is in action. More specifically, one trailing edge 28 may come to bear correctly in the guide device 22 and the next one may come out of the guide device 22 on account of the presence of a discontinuity. On coming out of the device, the risk of the fairing breaking is much greater. By contrast, the absence of a discontinuity, as shown in FIG. 3*b*, allows the different trailing edges 28 to come to bear continuously against the guide device 22, in particular during the passage from one trailing edge 28 to the next. The risk of a trailing edge 28 coming out of the guide device 22 is thus much lower.

Figure 4A:
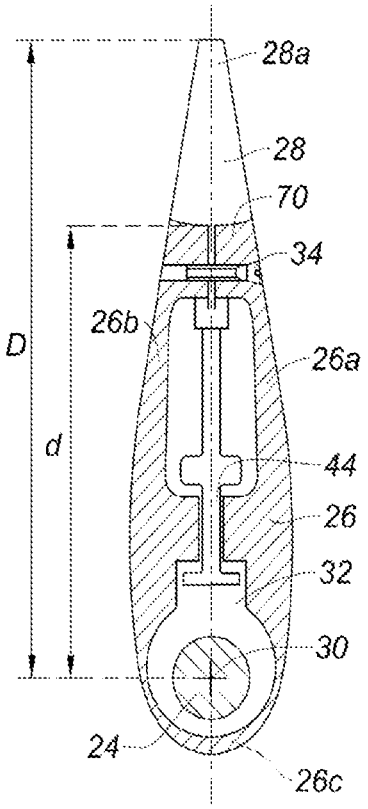
FIGS. 4*a* and 4*b* partially show the cable in two perpendicular section planes.
Figure 4B:
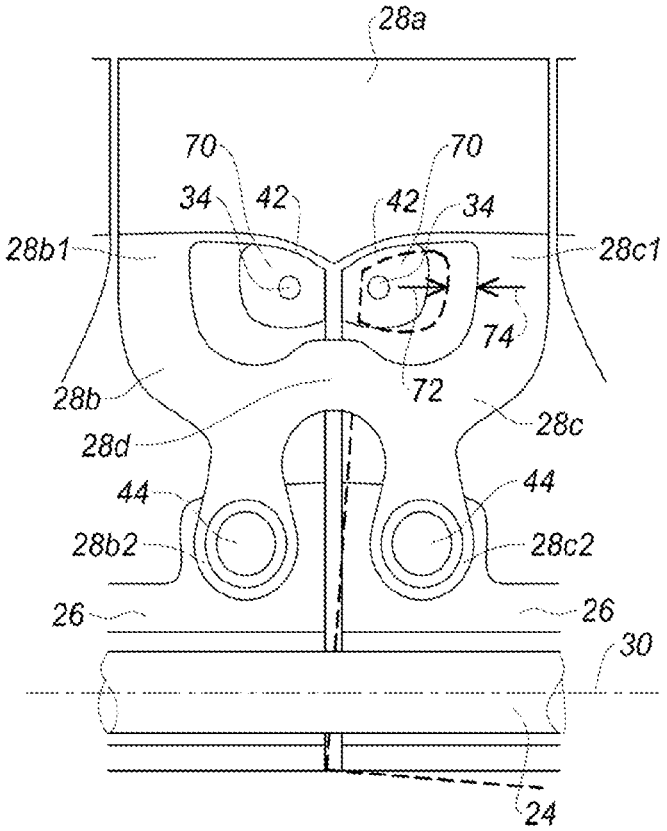

FIG. 4*a* shows the cable 14 in cross section in a plane perpendicular to the axis 30, and FIG. 4*b* shows a portion of the cable 14 in cross section in a plane containing the axis 30. The leading edge 26 is in one piece. It is made of a homogeneous material. The leading edge 26 surrounds the core 24. The leading edge 26 comprises a channel 32 in which the core 24 is disposed. A functional clearance is present between the core 24 and the channel 32 in order to allow the leading edge 26 to rotate freely about the core 24. The leading edge 26 is fitted around the core 24 by folding it in order to enclose the channel 32. In other words, the leading edge 26 forms a shell folded around the core 24.

More specifically, the leading edge 26 comprises two faces 26*a* and 26*b* and a connecting part 26*c* joining the two faces 26*a* and 26*b*. The faces 26*a* and 26*b* and also the connecting part 26*c* are substantially in the continuation of one another during the manufacture of the leading edge 26. The leading edge 26 is made for example of molded plastics material. Of course, any other manufacturing process is possible, such as machining or 3D printing.

After the leading edge 26 has been folded around the core 24, the connecting part 26*c* forms the surface of the channel 32 and the two faces 26*a* and 26*b* come into contact with one another. The two faces 26*a* and 26*b* are fastened together, for example by means of screws 34 or rivets.

The external surfaces of the faces 26*a* and 26*b* and of the connecting part 26*c* ensure the hydrodynamic function of the leading edge 26. During the orientation of the fairing element in the current, the connecting part 26*c* is positioned farthest upstream.

The trailing edge 28 comprises a profile 28*a* that ensures the hydrodynamic function of the trailing edge 28 and of two arms 28*b* and 28*c* that are each disposed inside two adjacent leading edges 26.

Perpendicularly to the axis 30 of the core 24, the fairing formed by the leading edges 26 and the trailing edges 28 is located at a distance D with respect to the axis 30. The distance d at which the leading edge is located is at least equal to half the distance D.

In a plane containing the axis 30 forming a plane of symmetry of the fairing, the projection of the leading edge 26 is substantially rectangular, with one side 36 being limited by the distance d. The projection of the profile 28*a* is likewise substantially rectangular. For the profile 28*a*, one of the sides 38 of the rectangle is limited by the distance d and another side 40 is limited by the distance D.

The ends of the side 36 may have rounded corners 42, having the form of chamfers or fillets. The profile 28*a* may follow the rounded corners 42. These shape configurations allow the trailing edges 28 to better follow the relative movements of the leading edges 26 that are caused by bending or twisting of the cable 14.

The leading edge 26 takes up the largest part of the external surface of the fairing. In other words, the leading edge 26 fulfills the majority of the hydrodynamic function of the fairing.

The leading edge 26 and the trailing edge 28 may be made of the same material, making it possible to standardize the manufacture of the different mechanical parts that form the fairing. Alternatively, it is possible to configure the relative flexibility of the leading edge 26 and of the trailing edge 28, in particular, by keeping the leading edge 26 with a high level of rigidity and by giving the trailing edge 28 greater flexibility. The various leading edges 26 and the various trailing edges 28 may be in one piece and made of homogeneous materials. The Young's modulus (also known as longitudinal elastic modulus) forming the leading edges 26 is thus greater than the Young's modulus of the material forming the trailing edges 28. This allows the fairing to better follow the movements of the cable 14 in the water, during bending or twisting. In addition, the trailing edges 28 have a smaller cross section than that of the leading edges 26. The trailing edges 28 are therefore more fragile than the leading edges 26. By choosing a more flexible material for the trailing edges 28, the risk of the latter breaking is reduced. By way of example, tests were carried out in-house by the applicant with leading edges 26 produced by molding a plastics material formed of a mixture of polycarbonate (PC) and polybutylene terephthalate (PBT) having a Young's modulus of around 2150 MPa. The trailing edges 28, for their part, were produced by molding a material based on polyurethane having a Young's modulus of around 548 MPa. More generally, as soon as the Young's modulus of the material forming the leading edges 26 is greater than that of the material forming the trailing edges 28, the result is already advantageous. This is because, since the leading edges 26 have thicknesses, defined perpendicularly to the plane of FIG. 4*b*, that are greater than those of the trailing edges 28, a small difference between the Young's moduli already allows much greater deformation of a trailing edge 28 compared with a leading edge 26 under the same force. With a Young's modulus of the material forming the leading edges 26 at least twice the Young's modulus of the material forming the trailing edges 28, the results are better, and with a Young's modulus of the material forming the leading edges 26 at least four times the Young's modulus of the material forming the trailing edges 28, the results are excellent.

For plastics materials, the Young's modulus can be determined by referring to the standard ISO 178. In practice, the characterization of the Young's moduli of the materials is relative. It is therefore enough to implement the same measurement conditions to compare the Young's moduli of the materials forming the leading edges 26 and the trailing edges 28.

The arms 28*b* and 28*c* extend at least in a direction perpendicular to the axis 30. Thus, the trailing edge 28 is in the overall shape of a U. More specifically, the profile 28*a* forms the bottom part of the U shape and the arms 28*b* and 28*c* form the legs of the U shape.

The arms 28*b* and 28*c* make it possible to hold the trailing edge 28 on two adjacent leading edges 26. The arms 28*b* and 28*c* are anchored in the profile 28*a*. The arms 28*b* and 28*c* do not provide any hydrodynamic function. The arms 28*b* and 28*c* are each disposed entirely inside one of the leading edges 26. Thus, the definition of the arms 28*b* and 28*c* may be much freer, in particular to adapt the deformation thereof as required and in particular to allow the fairing to withstand bending and twisting of the core 24. The definition of the shapes and dimensions of the arms 28*b* and 28*c* is not subject to the constraints of the hydrodynamic functions of the fairing.

More specifically, each of the arms 28*b* and 28*c* comprises two ends, 28*b*1, 28*b*2 for the arm 28*b* and 28*c*1, 28*c*2 for the arm 28*c*. The ends 28*b*1 and 28*c*1 are secured to the profile 28*a*. The ends 28*b*2 and 28*c*2 are free and each held on a leading edge 26. An arm 28*b* or 28*c* can be held on a leading edge 26 by means of a complete connection. The relative movements of the trailing edge 28 with respect to the two leading edges 26 to which the trailing edge 28 is fastened are ensured by the elasticity of the arms 28*b* and 28*c*.

Alternatively, and as shown in FIGS. 4*a* and 4*b*, the free ends 28*b*2 and 28*c*2 are each linked to a leading edge 26 by means of a pivot connection 44. This pivot connection 44 allows the elasticity of the arms 28*b* or 28*c* to be stressed less during relative movements of the trailing edge 28 with respect to the leading edges 26 to which the trailing edge 28 is linked during twisting or bending of the cable 14.

The arms 28*b* and 28*c* extend at least in a direction perpendicular to the axis 30. More specifically, between their ends, the arms 28*b* and 28*c* can extend perpendicularly to the axis 30 or be inclined with respect to a direction perpendicular to the axis 30 as shown in FIG. 4*b*. It is important, however, to maintain, in the projection of a direction connecting the ends of an arm, a component perpendicular to the axis 30. This component, and more generally the U shape of the trailing edge 28, allows greater flexibility of the link between the trailing edge 28 and the two corresponding leading edges 26 during bending or twisting of the cable 14. More specifically, in the prior art, the splice plates keeping the fairings together extend parallel to the axis 30 and are therefore subjected to tension or compression during bending and even during twisting of the cable. By contrast, in the proposed variant of the invention, the arms 28*b* and 28*c*, on account of their orientation, undergo bending, which allows greater deformation than tension, resulting in better flexibility of the proposed links. Furthermore, during twisting of the cable 14, the base of the U, that is to say the profile 28*a*, undergoes both tension and bending. Thus, the proposed variant improves the flexibility of the fairing during bending of the cable 14, making it easier for the cable 14 to pass through the guide means 22, such as a pulley, this passage tending to bend the cable 14. By contrast, the proposed variant maintains a high level of stiffness with regard to twisting of the cable 14, making it possible to limit this twisting.

The arms 28*b* or 28*c* may be independent of one another. Alternatively, as shown in FIG. 4*b*, the trailing edge 28 may comprise an intermediate arm 28*d* connecting the two arms 28*b* or 28*c*. The intermediate arm 28*d* is substantially disposed inside two adjacent leading edges 26. The intermediate arm 28*d* may be secured to each of the arms 28*b* or 28*c* halfway between each of the ends of the arms 28*b* or 28*c*. The intermediate arm 28*d* forms, with the free parts of the arms, which extend as far as the free ends 28*b*2 and 28*c*2, a U shape that has the same advantages as those described above. The presence of the intermediate arm 28*d* makes it possible to adjust the flexibility of the fairing with regard to the effects of bending of the cable 14 and the stiffness thereof with regard to twisting of the cable 14.

Figure 5:
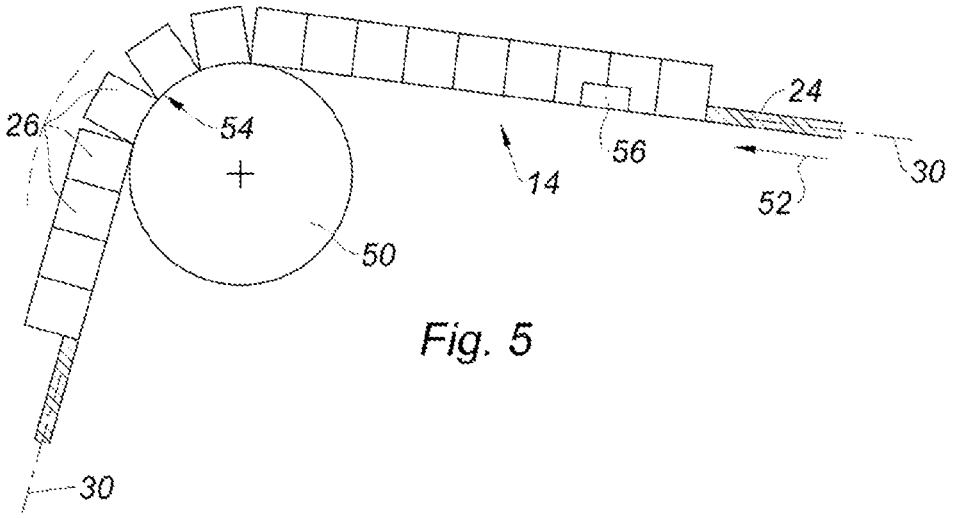
FIG. 5 shows the cable passing over a pulley.

FIG. 5 shows a portion of cable 14, the direction of the axis 30 of which is diverted by a pulley 50 forming an example of a guide device 22. In FIG. 5, the cable 14 is schematically depicted and only the core 24 and the leading edges 26 are shown. The trailing edges 28 are not shown. The cable 14 moves in the direction 52 of the axis 30. Upstream of the pulley 50, the speed of the cable 14 is denoted Vc. More specifically, when the cable 14 is straight, the speed of the core 24 and the speed of the leading edges 26 are the same, namely Vc. By contrast, when the cable 14 bends, in particular on passing around the pulley 50, the axis 30 of the core 24 continues at this same speed Vc but the different areas of the leading edge 26 do not all exhibit the same linear speed, which depends on the distance thereof from the axis of the pulley 50.

More specifically, it was shown above that the leading edge 26 surrounds the core 24. When the cable 14 is in contact with the pulley 50, in the area in which the axis 30 follows a portion of a circle, the part 26*c* of the leading edge 26 that is closest to the center of the pulley 50 and is indicated by the arrow 54 has a speed lower than Vc. This lower speed tends to cause the leading edges 26 to slip in the upstream direction of the cable 14. The leading edges 26 are thus pressurized against one another, generating stresses in the leading edge 26 that are oriented along the axis 30. This pressure is absorbed by a ring 56 crimped on the core 24.

Several rings are distributed along the core 24 in order to periodically absorb the axial forces of the different fairings. It is possible to make an incision in several leading edges 26 at their respective channels, this incision being perpendicular to the axis 30. Thus, a leading edge incorporates a ring. This particular leading edge can thus bear either on one side of the ring or on the other. In other words, a leading edge absorbs the forces in the two directions of the axis 30. However, such a configuration forces a leading edge to absorb axial forces both in tension and in compression.

It is also possible to do away with the absorption of tensile force in order to limit the risk of creeping of the leading edges 26. To this end, as shown in FIG. 5, the rings 56 are disposed between two adjacent leading edges.

Furthermore, the part 26*c* is pressurized by the core 24 against the pulley 50. This pressure against the pulley generates stresses in the leading edge 26 that are oriented radially toward the center of the pulley 50.

Figures 6A, 6B, 6C:
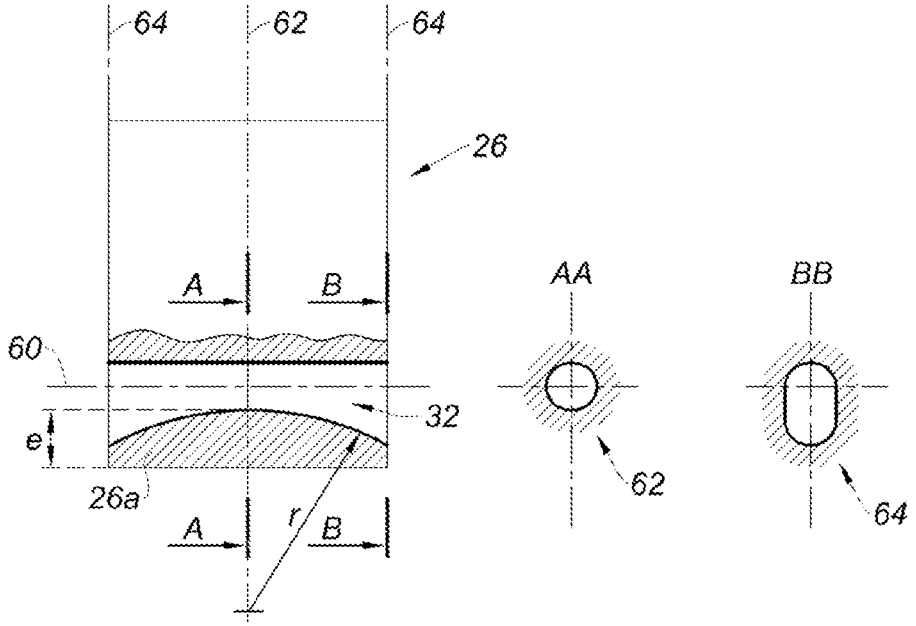
FIGS. 6*a*, 6*b*, 6*c* and 6*d* illustrate a variant of a leading edge of the cable.
Figure 6D:
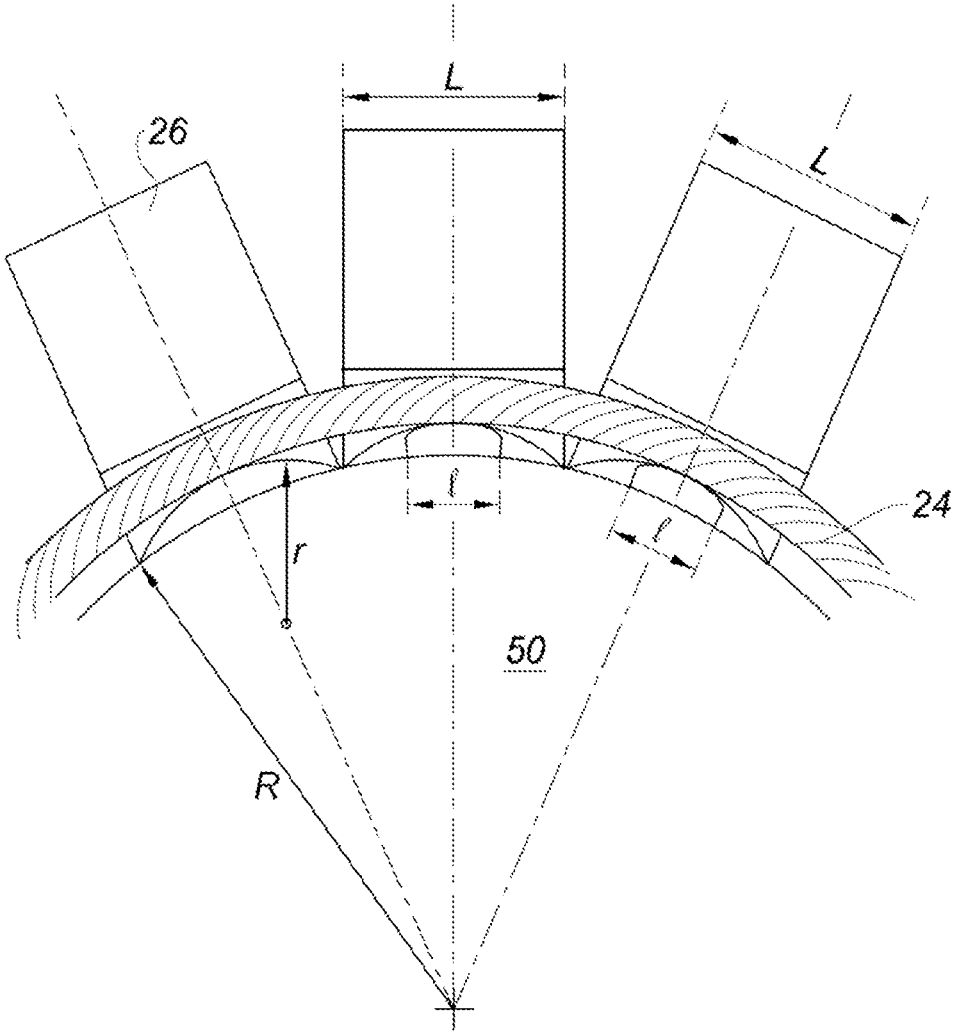

FIGS. 6*a* and 6*d* show a particular form of the leading edges 26 that makes it possible to limit the effects of the reduction in speed of the part 26*c* of the leading edge 26. FIG. 6*a* shows a leading edge 26 on its own and FIG. 6*d* shows a portion of cable wound over a pulley 50. The channel 32 extends mainly along an axis 60 of the leading edge 26 that is coincident with the axis 30 of the core 24 when the cable 14 is straight. The channel 32 widens on either side of a median section 62 of the leading edge 26, the section 62 being perpendicular to the axis 60. This makes it possible to better distribute the pressure that the core 24 exerts on the walls of the channel 32 when the cable 14 bends. As a result of the channel 32 widening, the pressure is reduced in the sections farthest away from the section 62. The sections can be defined such that, for a given bend of the cable 14, in particular depending on the diameter of the pulley 50, the core 24 is not in contact with the sections farthest away from the section 62 but only with sections that are closest to the section 62. This makes it possible to limit the risks of creeping of the material forming the leading edge 26 when it is pressurized by the core 24.

The channel 32 may be formed of circular sections about the axis 30. Alternatively, in order to improve the rigidity of the leading edge 26, the sections of the channel 32 are defined in an asymmetric manner about the axis 60, as shown in FIGS. 6*a* and 6*d*. More specifically, in the section 62, shown in cross section in FIG. 6*b*, the channel 32 has a circular contour, and in the sections 64 that are farthest away from the section 62 and shown in cross section in FIG. 6*c*, the channel 32 has an elongate contour extending toward the interior of the pulley 50. Between the sections 62 and 64, the walls of the channel 32 follow for example a circular curve of radius r centered on a point belonging to the median section 62. The radius r is defined such that r-e is less than the radius R of the pulley 50, e being the thickness of the part 26*a* in the median section 62. Thus, even if the core 24 partially squashes the internal surface of the channel 32, the length of contact of the core 24, denoted I in FIG. 6*d*, remains less than the length L of the leading edge 26, the lengths I and L being defined along the axis 60 of the channel 32.

When the towing cable 14 bends about a pulley 50, the parts of the leading edges 26 that are farthest away from the center of the pulley 50 tend to move apart. The corresponding trailing edges 28 have to follow this movement apart. The presence of the pivot connection 44 at the free end 28*b*2 and 28*c*2 of each of the arms 28*b* and 28*c* allows the rotation of the trailing edge 28 with respect to each of the leading edges 26 to which the trailing edge 28 is articulated. The pivot connections 44 are disposed as close as possible to the axis 30 in order to limit the movement of the pivot connections 44 apart from one another. For the trailing edge 28, this movement apart is absorbed by elastic deformation of the arms 28*b* and 28*c*. The lower Young's modulus of the trailing edge 28 associated with the shape of the arms 28*b* and 28*c* allows this deformation. At the ends 28*b*1 and 28*c*1 of the arms 28*b* and 28*c*, the relative movement of two leading edges is greater than at the pivot connections 44. In FIG. 4*b*, the possible movement of the leading edge 26 situated on the right in the figure is represented by dashed lines. In the bottom part of FIG. 4*b*, the two leading edges 26 come into abutment and move apart at the top. At the ends 28*b*1 and 28*c*1, the arms 28*b* and 28*c* can slide in the plane of FIG. 4*b* with respect to the corresponding leading edges 26.

Other relative movements of the leading edges 26 and of the trailing edges 28 are possible, in particular twisting as shown in FIG. 3*b*. Twisting may bring about a greater relative movement than bending as shown by dashed lines in FIG. 4*b*, the coming of the leading edges 26 into abutment then being ineffective. It is advantageous, however, to provide for the relative movement between a leading edge 26 and a trailing edge 28 linked by their pivot connection 44 to be limited. This movement is substantially a rotation about the axis of the pivot connection 44 give or take functional clearances and deformations. To this end, the leading edge may comprise two stops in the form of bosses 70 that are intended each to bear against an arm 28*b* or 28*c*. The bosses 70 may be used for the passage of the screws 34, as can be seen in FIG. 4*a*. The bosses 70 form protuberances that connect the faces 26*a* and 26*b* of the leading edge 26. In FIG. 4*b*, one of the bosses 70 is also shown by dashed lines during bending of the core 24. In this position, the boss 70 is still at a distance from the arm 28*c*. During a larger relative movement, the boss 70 comes into abutment against the arm 28*c*. This is illustrated by a point 72 of the boss 70 and a point 74 of the arm 28*c* coming into contact with one another. These two points 72 and 74 are indicated by solid arrows in FIG. 4*b*. It is, of course, possible to dispense with a stop between two leading edges 26 and to keep only the stop 70. The position of this stop is defined in particular depending on the diameter of the pulley 50 or that of a drum 20 and more generally on the maximum deformation allowed for the cable 14.

The invention claimed is:

1. A faired towing cable intended to tow a submersible body, the faired towing cable comprising a core and a fairing joined to the core, the fairing being profiled so as to reduce a hydrodynamic drag of the faired towing cable, the fairing comprising several leading edges and several trailing edges joined to the leading edges, wherein one trailing edge of the trailing edges is held directly on two adjacent leading edges, and each of the leading edges and the trailing edges are in one piece and made of one or more homogeneous materials, and in that a Young's modulus of a material forming the leading edges is greater than a Young's modulus of a material forming the trailing edges.

2. The faired towing cable as claimed in claim 1, wherein the core extends along an axis, and the trailing edges are disposed in a staggered manner with respect to the leading edges along the axis.

3. The faired towing cable as claimed in claim 1, wherein the core extends along an axis, wherein each of the leading edges form a shell folded around the core, and wherein each trailing edge is formed of:

a profile that ensures a hydrodynamic function of each said trailing edge, and two arms that are each disposed inside one of two adjacent leading edges to said each trailing edge, wherein each arm extends at least in a direction perpendicular to the axis, and each arm is held on one of said two adjacent leading edges.

4. The faired towing cable as claimed in claim 3, wherein each arm of each trailing edge comprises two ends, a first end which is secured to the profile of said each trailing edge, and a second end which is held on one of said two adjacent leading edges to said each trailing edge.

5. The faired towing cable as claimed in claim 4, wherein each arm is held on one of said two adjacent leading edges to said each trailing edge by a pivot connection.

6. The faired towing cable as claimed in claim 5, wherein each leading edge comprises two stops that can each come into contact with a corresponding one of the arms so as to limit relative movement of each trailing edge and of each leading edge connected by the pivot connection.

7. The faired towing cable as claimed in claim 3, wherein said each trailing edge comprises an intermediate arm connecting the two arms.

8. The faired towing cable as claimed in claim 1, wherein the core extends along an axis, and, for the each of leading edges and trailing edges, in a direction perpendicularly to the axis of the core, the fairing is located at a distance D with respect to the axis, and a distance d at which the leading edges are located is at least equal to half the distance D.

9. The faired towing cable as claimed in claim 7, wherein in a plane containing the axis, a projection of each leading edge is substantially rectangular, with a side of said projection of each leading edge being disposed by the distance d from the axis, and a projection of the profile of each trailing edge is substantially rectangular, with a first side of said projection of each profile being disposed by the distance d from the axis, and a second side of said projection of each profile being disposed by the distance D.

10. The faired towing cable as claimed in claim 8, wherein ends of a side of each of the leading edges have rounded corners, and a profile of each of the leading edges is configured to follow the rounded corners.

11. The faired towing cable as claimed in claim 1, wherein rings fastened to the core are distributed regularly along the core, the leading edges being able to bear on the rings, and each the rings are disposed between two adjacent leading edges.

12. The faired towing cable as claimed in claim 1, wherein the core extends along an axis of the core, each leading edge comprises a channel which extends substantially along an axis of the channel and wherein the core is disposed, and the channel widens on either side of a median section of the leading edge, the median section being perpendicular to the axis of the channel.

* * * * *